US012281534B2

(12) United States Patent
Infante

(10) Patent No.: US 12,281,534 B2
(45) Date of Patent: Apr. 22, 2025

(54) SYSTEMS AND METHODS FOR RUNNING TUBULARS

(71) Applicant: Tubular Technology Tools, LLC, Fulshear, TX (US)

(72) Inventor: Jairo Gutierrez Infante, Funza (CO)

(73) Assignee: Tubular Technology Tools LLC, Fulshear, TX (US)

( * ) Notice: Subject to any disclaimer, the term of this patent is extended or adjusted under 35 U.S.C. 154(b) by 0 days.

(21) Appl. No.: 18/406,237

(22) Filed: Jan. 8, 2024

(65) Prior Publication Data

US 2024/0141743 A1 May 2, 2024

Related U.S. Application Data

(63) Continuation of application No. 17/639,466, filed on Mar. 1, 2022, which is a continuation of application No. PCT/IB2020/060729, filed on Nov. 14, 2020.

(60) Provisional application No. 62/940,756, filed on Nov. 26, 2019.

(51) Int. Cl.

| | |
|---|---|
| ***E21B 19/07*** | (2006.01) |
| ***E21B 19/16*** | (2006.01) |
| ***E21B 31/20*** | (2006.01) |

(52) U.S. Cl.

CPC ..... *E21B 31/20* (2013.01); *E21B 19/07* (2013.01); *E21B 19/16* (2013.01)

(58) Field of Classification Search

CPC ..... E21B 19/07

See application file for complete search history.

(56) References Cited

U.S. PATENT DOCUMENTS

| | | | |
|---|---|---|---|
| 1,441,583 | A | 1/1923 | Humason |
| 1,843,537 | A | 2/1932 | Bickerstaff |
| 2,184,681 | A | 12/1939 | Osmun |
| 2,191,000 | A | 2/1940 | Thomas |
| 2,769,655 | A | 11/1956 | Holmes |
| 6,309,002 | B1 | 10/2001 | Frank's |
| 6,431,626 | B1 | 8/2002 | Frank's |
| 6,679,333 | B2 | 1/2004 | Canrig |
| 6,732,822 | B2 | 5/2004 | Frank's |
| 6,742,584 | B1 | 6/2004 | Nabors |
| 6,920,926 | B2 | 7/2005 | Canrig |
| 7,140,443 | B2 | 11/2006 | Nabors |
| 7,377,324 | B2 | 5/2008 | Nabors |
| 7,445,050 | B2 | 11/2008 | Nabors |
| 7,770,654 | B2 | 8/2010 | Nabors |
| 8,240,371 | B2 | 8/2012 | Nabors |

(Continued)

FOREIGN PATENT DOCUMENTS

| | | |
|---|---|---|
| WO | WO2006116870 | 11/2006 |
| WO | WO2010006445 | 1/2010 |

*Primary Examiner* — D. Andrews
*Assistant Examiner* — Ronald R Runyan
(74) *Attorney, Agent, or Firm* — Victor H. Segura

(57) ABSTRACT

A tubular running tool equipped with a mandrel having an elongated body with a longitudinal axis. The mandrel is configured with a plurality of offset stepped ramps. A plurality of slips are disposed on the mandrel with stepped ramps configured for complementary engagement with the mandrel offset ramps. The mandrel is configured for actuation to urge the slips radially outward for engagement of a gripping portion on the slips with an inner surface of a tubular. A method using the tool for running a tubular and providing a makeup torque.

18 Claims, 10 Drawing Sheets

(56) References Cited

U.S. PATENT DOCUMENTS

| | | | | |
|---|---|---|---|---|
| 8,881,496 | B2 | 11/2014 | Bosman | |
| 8,893,772 | B2 | 11/2014 | Henderson | |
| 9,057,234 | B2 | 6/2015 | Nabors | |
| 10,954,736 | B2 | 3/2021 | Weatherford | |
| 2001/0042625 | A1 | 11/2001 | Appleton | |
| 2009/0272543 | A1* | 11/2009 | Bouligny | E21B 19/16 414/800 |
| 2009/0314496 | A1* | 12/2009 | Begnaud | E21B 19/07 166/380 |
| 2011/0132594 | A1 | 6/2011 | Slack | |
| 2012/0160517 | A1* | 6/2012 | Bouligny | E21B 19/155 166/380 |
| 2014/0076538 | A1* | 3/2014 | Shute | E21B 33/05 166/177.4 |
| 2014/0097960 | A1 | 4/2014 | Guidry | |
| 2019/0284894 | A1 | 9/2019 | Schmidt | |

* cited by examiner

SYSTEMS AND METHODS FOR RUNNING TUBULARS

CROSS-REFERENCE TO RELATED APPLICATIONS

Continuation-in-Part of U.S. patent application Ser. No. 17/639,466 filed Mar. 1, 2022, which is a Continuation of International Application No. PCT/IB2020/060729 filed Nov. 14, 2020, which claims priority from U.S. Provisional Application No. 62/940,756 filed on Nov. 26, 2019. All the foregoing applications are incorporated herein by reference in their entirety.

BACKGROUND

The present disclosure relates generally to methods and apparatus for manipulating tubulars, and more particularly, to techniques for running (e.g., hoisting, moving, and lowering) tubulars for disposal in a wellbore.

The drilling and completion of subsurface wells involves assembling drill strings and casing strings, each of which entail multiple elongated, heavy tubular segments. A drill string consists of individual sections of pipe which are threadedly engaged together as the string assembly is lowered into a wellbore. Typically, the casing string is provided around the drill string to line the wellbore after drilling the hole, to ensure the integrity of the wellbore. The casing string also consists of multiple pipe segments threadedly coupled together during disposal into the wellbore.

Conventional techniques for assembling drill strings and casing strings entail the use of tools coupled to top drive assemblies. Such tools include manipulators designed to engage a pipe segment and hoist the segment up into a position for engagement to another pipe segment so the tubular assembly can be disposed into a wellbore. While such conventional tools facilitate the assembly of drill pipe and casing strings, such tools suffer from shortcomings. One such shortcoming is that these tools are generally designed for use with pipe segments of a specific internal/external diameter. When different diameter tubular segments are used (as is often the case in well operations), the running tool requires replacement with another tool designed to handle the particular diameter of the tubular in use. This results in inefficiencies producing time delays, added costs, greater risk of personnel injury, and equipment logistic complexity.

Thus, a need remains for improved techniques to efficiently and effectively manipulate or run tubulars.

SUMMARY

According to an aspect of the invention, a tubular running tool includes a mandrel having an elongated body with a longitudinal axis and a plurality of stepped ramps on a surface thereof. A plurality of the mandrel stepped ramps are offset from one another along the longitudinal axis of the mandrel. A plurality of slips are disposed on the mandrel, each slip having a plurality of stepped ramps, wherein the stepped ramps of the slips are configured for complementary offset engagement along the mandrel longitudinal axis with the stepped ramps of the mandrel. Each slip is configured with a gripping portion on a surface thereof. The mandrel is configured for actuation to urge the slips radially outward to move the gripping portion on each slip outward for engagement with a tubular.

According to another aspect of the invention, a method for running a tubular includes suspending a mandrel above a wellbore, the mandrel having an elongated body with a longitudinal axis and a plurality of stepped ramps on a surface thereof, wherein a plurality of the mandrel stepped ramps are offset from one another along the longitudinal axis of the mandrel, wherein a plurality of slips are disposed on the mandrel, each slip having a plurality of stepped ramps, wherein the stepped ramps of the slips are configured for complementary offset engagement along the mandrel longitudinal axis with the stepped ramps of the mandrel, and wherein each slip is configured with a gripping portion on a surface thereof. A section of the mandrel is disposed into a tubular, and the mandrel is actuated to urge the slips radially outward to move the gripping portion on each slip outward to engage the tubular.

BRIEF DESCRIPTION OF THE DRAWINGS

The following figures form part of the present specification and are included to further demonstrate certain aspects of the present disclosure and should not be used to limit or define the claimed subject matter. The claimed subject matter may be better understood by reference to one or more of these drawings in combination with the description of embodiments presented herein. Consequently, a more complete understanding of the present embodiments and further features and advantages thereof may be acquired by referring to the following description taken in conjunction with the accompanying drawings, in which like reference numerals may identify like elements, wherein:

DETAILED DESCRIPTION

The foregoing description of the figures is provided for the convenience of the reader. It should be understood, however, that the embodiments are not limited to the precise arrangements and configurations shown in the figures. Also, the figures are not necessarily drawn to scale, and certain features may be shown exaggerated in scale or in generalized or schematic form, in the interest of clarity and conciseness.

Figure 1:
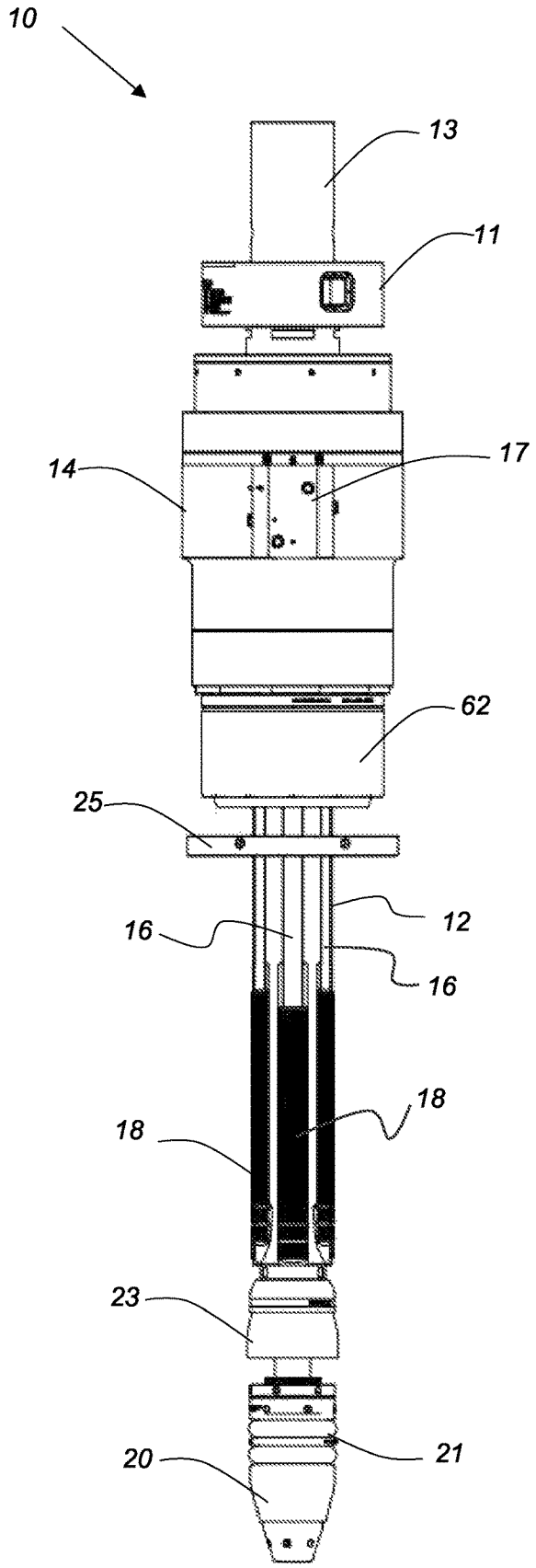
FIG. 1 shows a schematic of a tubular running tool according to an example of the present disclosure.

FIG. 1 shows a tubular running tool 10 embodiment of this disclosure. The tool 10 includes a torque housing 11, a mandrel 12, an actuator 14, a number of slips 16 disposed on the mandrel, with each slip 16 having a gripping portion 18 on an exterior surface, and a spear head 20 disposed at the distal end of the mandrel. The spear head 20 is elongated to support a series of O-rings 21 that assist to guide and center the mandrel 12 when the mandrel is inserted within a tubular, as described herein. Some spear head 20 embodiments may also be configured with a packer cup 23 at an upper end to provide sealing for the mandrel 12 when inserted within a tubular. The packer cup 23 also prevents fluids (e.g., drilling mud) from splashing out when fluids are pumped through the mandrel and into a connected tubular (further described herein). The packer may be formed of suitable rubber compounds as known in the art.

Figure 2:
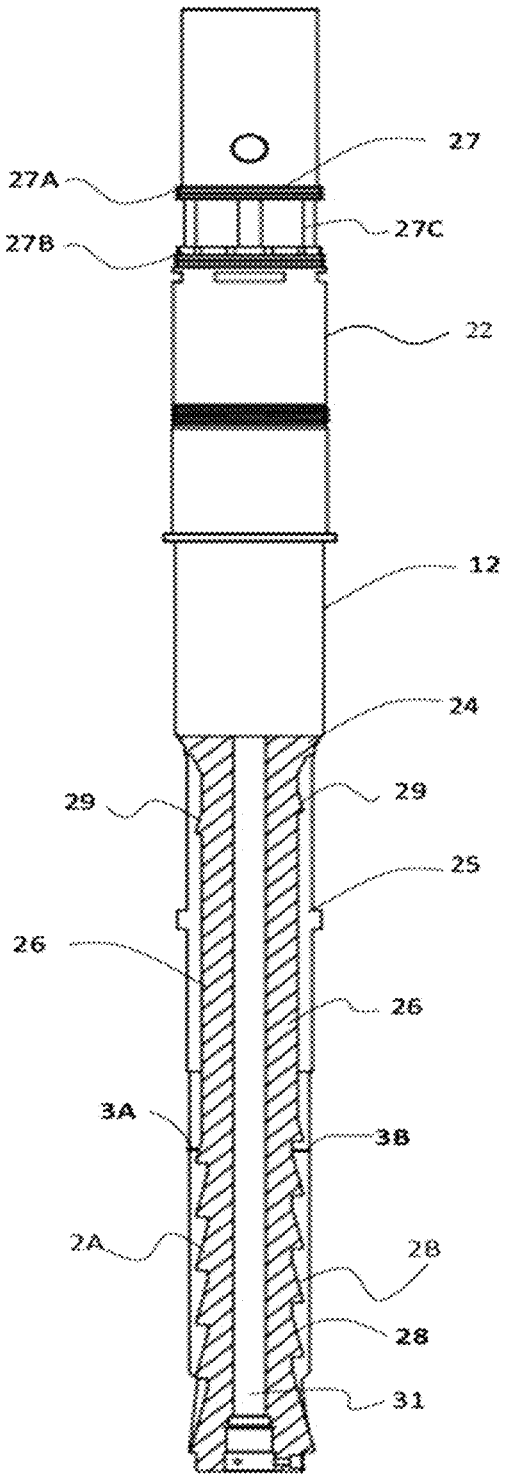
FIG. 2 shows a schematic of a mandrel according to an example of the present disclosure.

FIG. 2 shows an embodiment of a bare mandrel 12, without components disposed thereon. In one embodiment, the mandrel 12 is formed as a one-piece metallic (e.g. steel) tubular configured with an upper end 22 having a larger diameter compared to a stem 24 portion having a smaller diameter at an opposing end. As shown in FIG. 2, the stem 24 portion is configured with channels 26 running along the longitudinal axis of the mandrel 12. Mandrel 12 embodiments may be configured with one or more channels 26 formed therein. When multiple channels 26 are formed, they can be evenly spaced around the circumference of the tubular stem 24 portion and the number of channels may vary depending on the diameter of the mandrel 12 implementation. As shown in FIG. 2, each channel 26 is uniformly formed along a section of the stem 24 portion. Each channel 26 includes a plurality of stepped ramps 28 formed on the exterior mandrel 12 surface near the end or tip of the stem 24 portion. Each channel 26 also includes a superior ramp 29 formed on the exterior surface near the upper end of the channel. As shown in FIG. 2, a first set 2A of stepped ramps 28 are offset from a second set 2B of stepped ramps 28 along the longitudinal axis. In some embodiments, the first set 2A of stepped ramps 28 is disposed 180 degrees from the second set 2A of stepped ramps 28.

Some mandrel 12 embodiments are also configured with a torque sensor 27 (see item 11 in FIG. 1). In some embodiments, the torque sensor 27 consists of a pair of rings 27A, 27B with one or more torsion bars 27C linked between the rings. Upon application of rotational force to the mandrel 12 via the drive means, the lower part of the mandrel experiences the torque as applied to a tubular via the extended slips 16 and engaged gripping portions 18. The twisting force applied between the rings 27A, 27B produces a voltage difference which is digitally converted and wirelessly conveyed to an operator's readout to determine how much torque is being applied to the engaged tubular (See FIGS. 7B, 14B). A conventional gyroscope can also be implemented with the torque sensor 27 to monitor the mandrel 12 RPMs during operation. The integration of the torque sensor 27 with the mandrel 12 provides greater reliability and more accurate torque measurements. Other types of torque sensors 27 may be implemented with mandrel 12 embodiments as known in the art.

Figure 3:
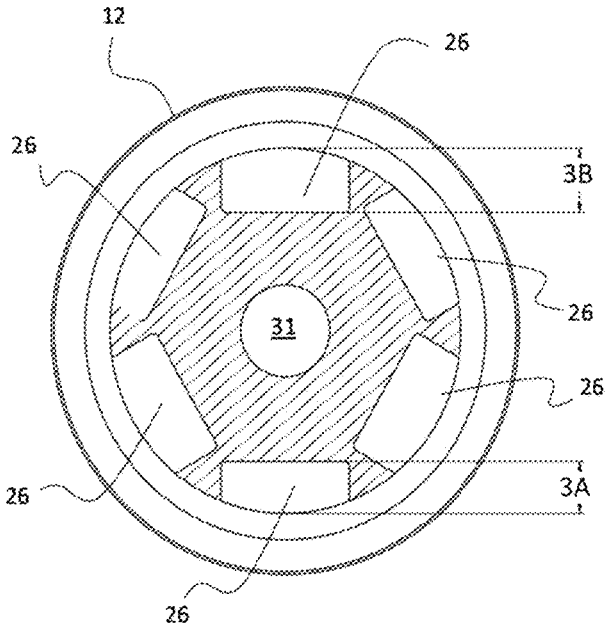
FIG. 3 shows an overhead cutaway cross section of a mandrel according to an example of the present disclosure.

FIG. 3 shows an overhead cutaway view of the mandrel 12 looking down from the upper end 22 of the mandrel. Some embodiments are configured with an even number of channels 26 formed along the longitudinal axis of the mandrel 12. Some embodiments are configured with the mandrel 12 having elongated channels 26 formed shallower 3A than other channels 3B along the longitudinal axis, with the channels 26 preferably disposed 180 degrees from one another. Returning to FIG. 2, the shallow channel 3A in FIG. 3 corresponds to the first set 2A of stepped ramps 28 at the section marked 3A in FIG. 2, and the other channel 3B corresponds to the second set 2B of stepped ramps 28 at the section marked 3B in FIG. 2. Mandrel 12 embodiments are also configured with an internal through bore 31 allowing for fluids to pass through the mandrel body and out through the spear head 20.

Figure 4A:
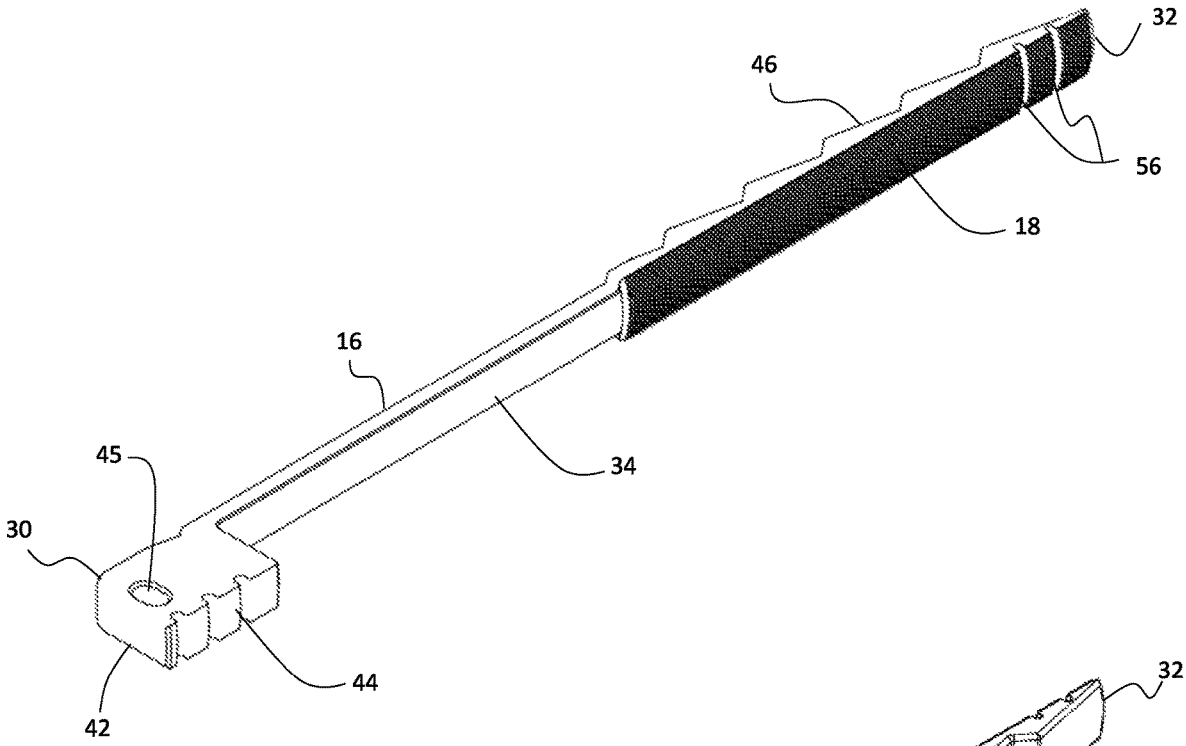
FIG. 4A shows a perspective view of a tool slip according to an example of the present disclosure

FIG. 4A shows a slip 16 embodiment of this disclosure. The slip 16 is formed as an elongated blade structure having an upper end 30, a lower end 32, and a stem 34 portion in between. FIG. 4A shows the surface of the slip 16 which faces outward when the slip is disposed within a channel 26 on the mandrel 12. The lower end 32 of the slip 16 includes a gripping portion 18. The gripping portion 18 may be formed via conventional techniques as known in the art (e.g., knurled surface, layer deposition, chemical treatment, shot peening, etc.). Each narrow slip 16 is configured to fit and reside within a channel 26 on the mandrel 12. The upper end 30 of the slip 16 has an elevation 42 that provides a retention shoulder for the slip at the upper end (further described below with respect to FIGS. 6, 7A, 7B). The elevation 42 also has one or more grooves 44 formed thereon to receive a flexible spring 60 (see FIG. 7A) to provide a constricting force against the slip 16. The opposing surface or backside of the slip 16 has a plurality of stepped ramps 46 formed thereon and configured for complementary engagement with the plurality of offset ramps 28 formed on the exterior of the mandrel 12 body. Some slip 16 embodiments are also configured with one or more grooves 56 formed on the gripping portion 18 near the lower end 32 of the slip. The groove(s) 56 is configured to receive a spring to provide a constricting force to keep the slips 16 from extending outward until actuated as described herein. A pivot hole 45 is also formed on each slip 16 near the upper end 30. The pivot hole 45 is elongated to receive a mounting pin 73 (see FIGS. 7A, 7B).

Figure 4B:
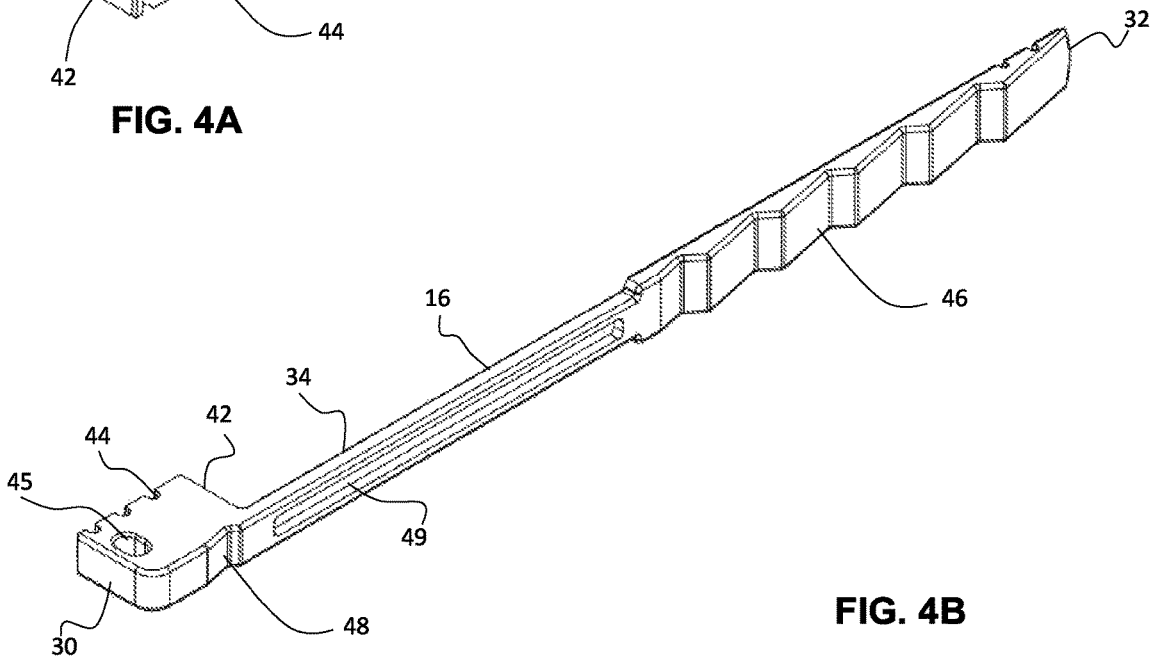
FIG. 4B shows a perspective view of the opposite side of the tool slip of FIG. 4A.

FIG. 4B shows the slip 16 embodiment of FIG. 4A from the backside or opposite surface that abuts against the mandrel 12 surface when the slip is disposed in the mandrel channel 26. A plurality of stepped ramps 46 are formed near the lower end 32 of the slip 16. These stepped ramps 46 are configured for complementary engagement with the stepped ramps 28 formed on the mandrel 12 surface. The slip 16 also includes a ramp 48 formed near the upper end 30 of the stem 34 on the opposite side of elevation 42. This ramp 48 is configured for complementary engagement with the superior ramp 29 formed on the mandrel 12 surface, as further described below. Some slip 16 embodiments are also configured with a channel 49 formed along the stem 34 portion to increase resistance against flexing along the stem.

Figure 5:
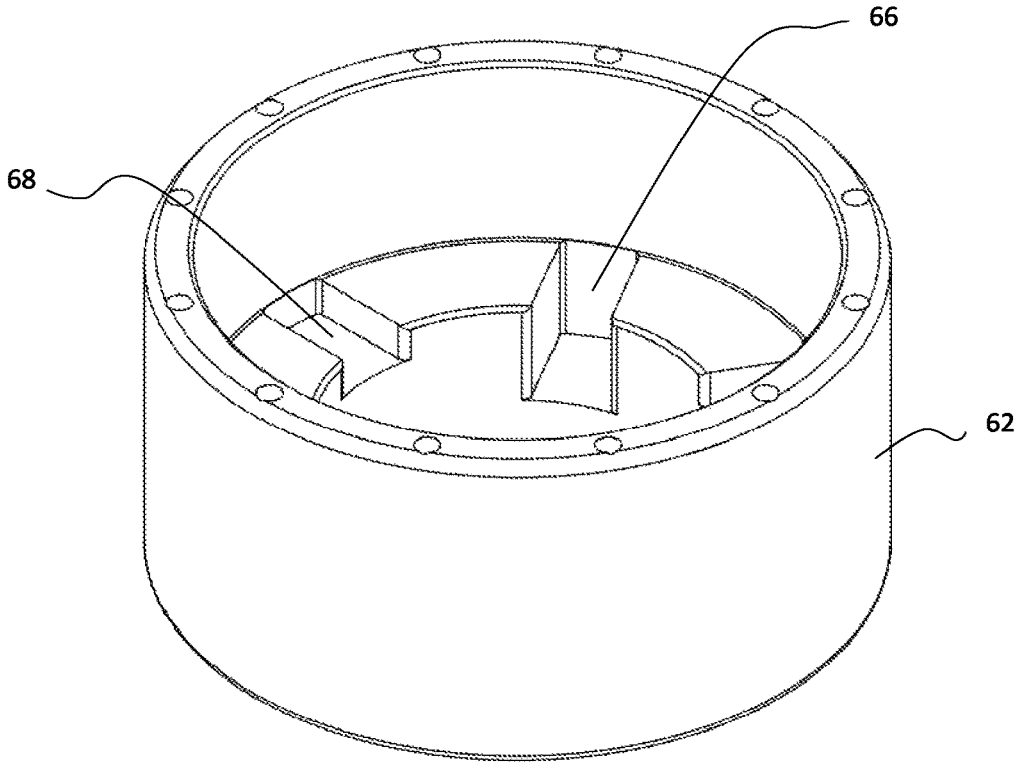
FIG. 5 shows a schematic of a connection plate according to an example of the present disclosure.

FIG. 5 shows an embodiment of a connection plate 62. This embodiment is configured as an annular ring structure having internal channels 66 formed thereon to accept and house the upper ends 30 of the slips 16 shown in FIGS. 4A and 4B. When disposed on the tool 10, the connection plate 62 surrounds and covers the slips 16 at the slip upper ends 30 (see FIG. 1). Each channel 66 includes a lower ledge 68 to guide the elevation 42 formed on the end of the slip 16, as shown in FIG. 6.

Figure 6:
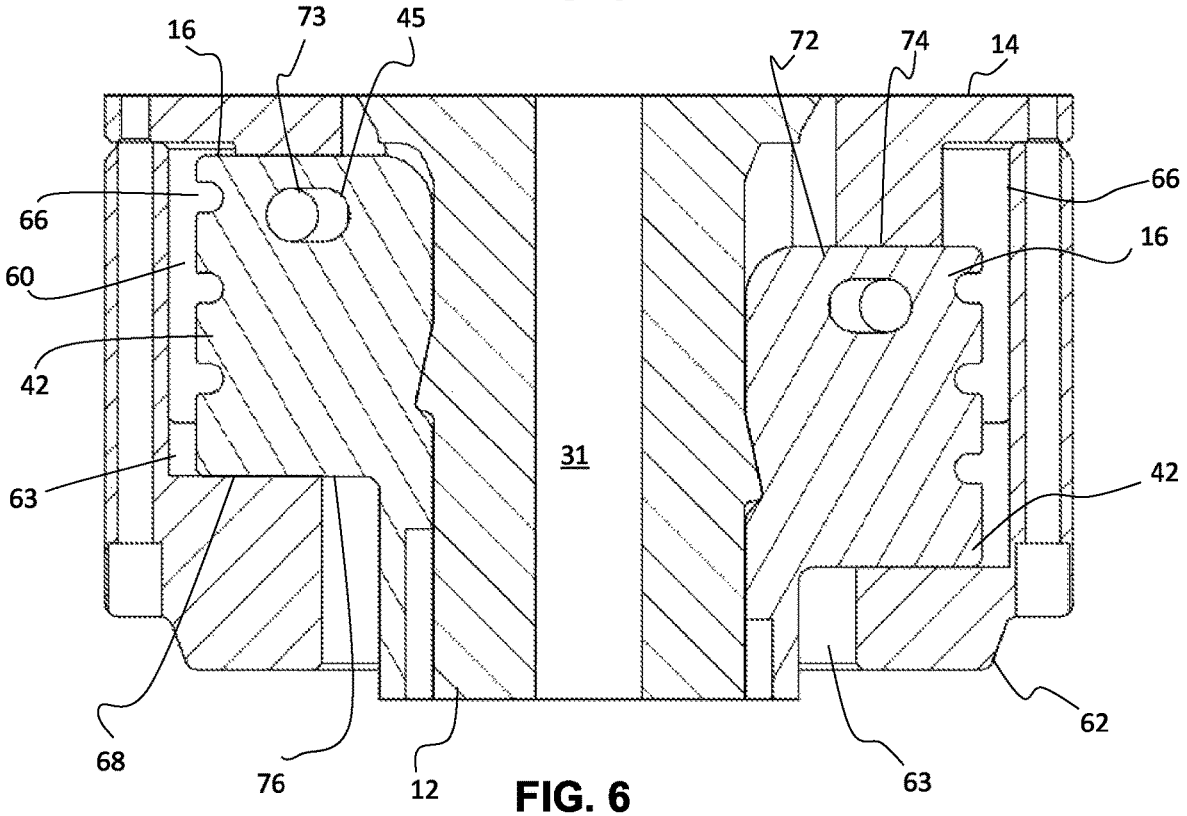
FIG. 6 shows a cross section of a mandrel and connection plate assembly according to an example of the present disclosure.

FIG. 6 shows a cross section of the tool 10 assembly at the connection plate 62. The upper end of the connection plate 62 is coupled to the actuator 14 (see FIG. 1). The internal channels 66 on the connection plate 62 provide the annular space 63 which permits the slips 16 to expand radially outward from the neutral position to the extended position in a parallel motion as disclosed herein. The upper ends 30 of the slips 16 are configured with a planar face 72 that abuts against a lower surface 74 of the actuator 14. The opposite end of the elevation 42 is configured with a planar face 76 that abuts against the lower ledge 68 of the connection plate 62. As shown in FIG. 6, embodiments may be formed with the internal channels 66 having different depths to accommodate placement of the slips 16 such that the mandrel 12 ramps 28, 29 are in complementary engagement with the offset ramps 46, 48 of the respective slips 16. Mounting pins 73 are also positioned accordingly for engagement with the respective pivot holes 45 on the slips 16.

Figure 7A:
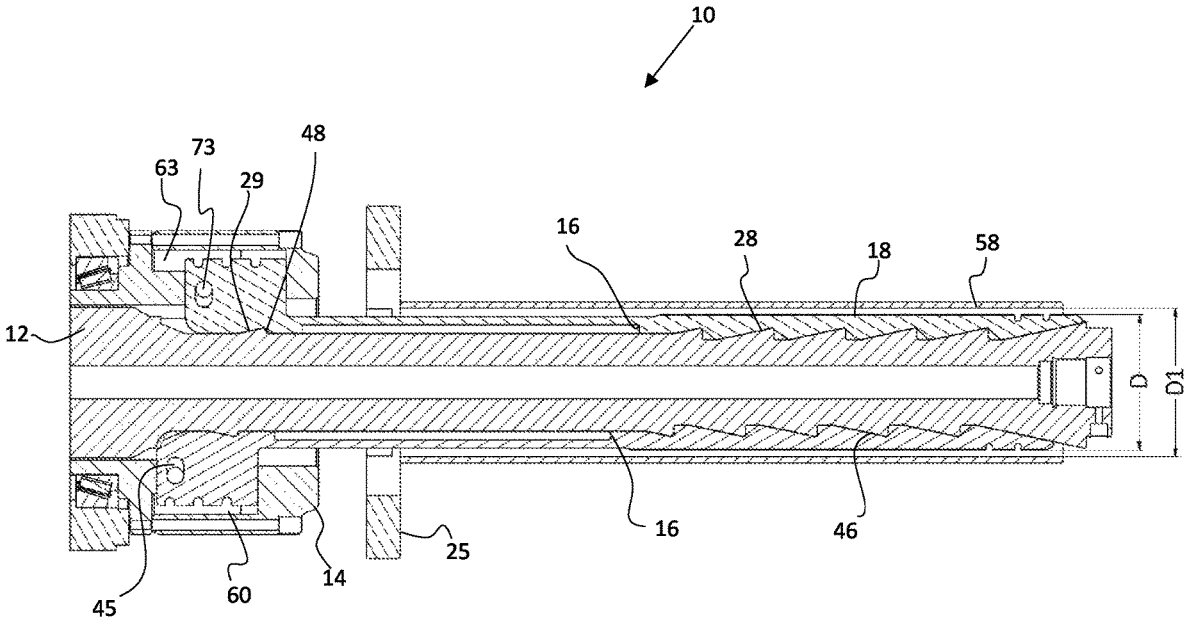
FIG. 7A shows a cross section of a mandrel in a neutral position within a tubular according to an example of the present disclosure.

FIG. 7A shows a cross section schematic of a tool 10 mandrel 12 embodiment of this disclosure configured with a pair of slips 16 as described with respect to FIGS. 4A and 4B. The end of the assembly is shown disposed in an open end of a tubular 58 having an inside diameter of D1. The assembly is inserted within the open end of the tubular 58 with the stepped ramps 46 of the slips 16 in complementary engagement with the offset stepped ramps 28 of the mandrel 12 at one end of the assembly. At the other end of the assembly, the superior ramp 29 of the mandrel 12 is in complementary engagement with the ramp 48 of the slip 16. In this mode, the tool 10 is in the neutral position. In the neutral position, the lands of the ramps 28, 46 and 29, 48 are mated in a low position such that the slips 16 lie close to the mandrel 12 body. In the neutral position, the overall tool assembly diameter is at a minimum D, which allows the tool to be disposed into the end of a tubular 58 of inner diameter D1 (where D1>D). FIG. 7A shows a cross section of a flexible spring 60 situated within the groove 44 on the slip 16. The spring 60 provides a constricting force to maintain the ramp 48 of the slip 16 in contact with the superior ramp 29 of the mandrel 12. Any suitable conventional spring 60 may be used (e.g., metallic toroidal spring).

The tool 10 is configured with a connection plate 62 as described with respect to FIG. 5. The connection plate 62 provides an annular space 63 which permits the slips 16 to expand radially outward from the neutral position to an extended position when the actuator 14 is actuated to move the mandrel 12, which in turn moves the ramps 28, 29 as described with respect to FIG. 7B.

Figure 7B:
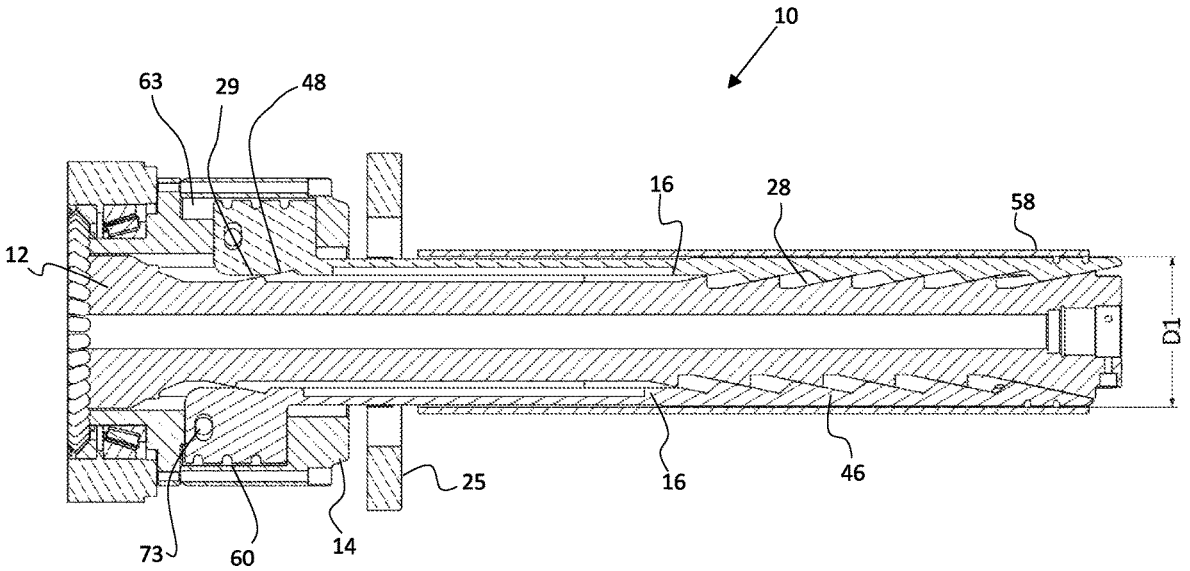
FIG. 7B shows a schematic of the mandrel of FIG. 7A in an extended position within the tubular according to an example of the present disclosure.

FIG. 7B shows the tool 10 with the mandrel 12 moved axially (to the left in FIG. 7B), while the slips 16 remain stationary in the axial direction. As the mandrel 12 moves axially (e.g., up or towards the upper end of the tool 10), the stepped ramps 28 and the superior ramp 29 on the mandrel 12 respectively slide against the ramps 46, 48 of the slips 16. As depicted in FIG. 7B, as the peaks of the ramps 28, 29 on the mandrel 12 slide axially against the ramps 46, 48 on the slip 16, the mandrel ramp peaks urge the slip ramps radially outwards. By configuring the mandrel 12 and slips 16 with the ramps 28, 29, 46, 48 as disclosed herein, the slips 16 remain parallel to the longitudinal axis of the mandrel as the slips are actuated to expand radially outward, as depicted in FIG. 7B. This configuration provides an advantage as it reduces component fatigue compared to slip configurations which pivot only at one end. As the slips 16 are actuated to expand radially outward, the gripping portion 18 on the outer surface of each slip is correspondingly urged radially outward such that the gripping portions remain parallel to the longitudinal axis of the mandrel as it makes contact with and secures against the inner diameter surface of the tubular 58. Once the tool 10 end is disposed in the open end of a tubular 58 and actuated to the extended position as described herein, the tubular is engaged and can be manipulated (e.g., raised, suspended, transported, lowered, rotated and/or torqued in connection with another tubular, etc.) by movement of the assembly as desired.

As shown in FIGS. 7A, 7B, and 14A, 14B, the implementation of offset ramps 28, 29, 46, 48 allows for extension of the slips 16, and therefore the corresponding gripping portions 18, at different stages. For example, with the implementation of multiple slips 16, when one ramp pair 28, 46 on one mandrel/slip mating is at a particular stage of inclination, another ramp pair mating on another slip is at a different stage of inclination. Staggering of the ramps 28, 29, 46, 48 in the disclosed manner provides an increase in the overall area of ramp contact surfaces. Some embodiments displayed approximately a 12% increase in actuatable contact area. This permits greater compression force to be applied to the tubular 58 ID via the gripping portions 18 on the slips 16. The increased gripping force allows for increased torque to be applied to the engaged tubular 58, which meets the high torque requirements of conventional tubular connections.

FIGS. 7A and 7B also show an embodiment configured with a stop bumper 25. The stop bumper 25 is implemented as a radial plate disposed on the mandrel 12 near the actuator 14. When the tool 10 mandrel 12 is inserted into the open end of a tubular 58, it is not always visible to an operator whether the griping portions 18 on the slips 16 have been fully inserted within the tubular or only partially inserted. Partial insertion of the slips 16, and the corresponding gripping portions 18, could result in a dropped tubular 58 and a potential disaster for the operator. With the stop bumper 25, the mandrel 12 is inserted within the tubular 58 until the end of the tubular abuts against the bumper, which in turn actuates a switch mechanism on the bumper that sends a wireless signal to indicate the tool 10 is fully set in the tubular and ready for extension of the slips 16 to manipulate the tubular. Some embodiments may be configured with a controller configured to prevent actuation of the slips 16 unless the stop bumper 25 switch mechanism sends the signal indicating full insertion of the gripping portions 18 within the tubular 58. Any conventional switching means may be used to implement embodiments of the invention (e.g., electrical contact, light detection, magnetic pickup, spring-loaded mechanical plunger, etc.).

Figure 8:
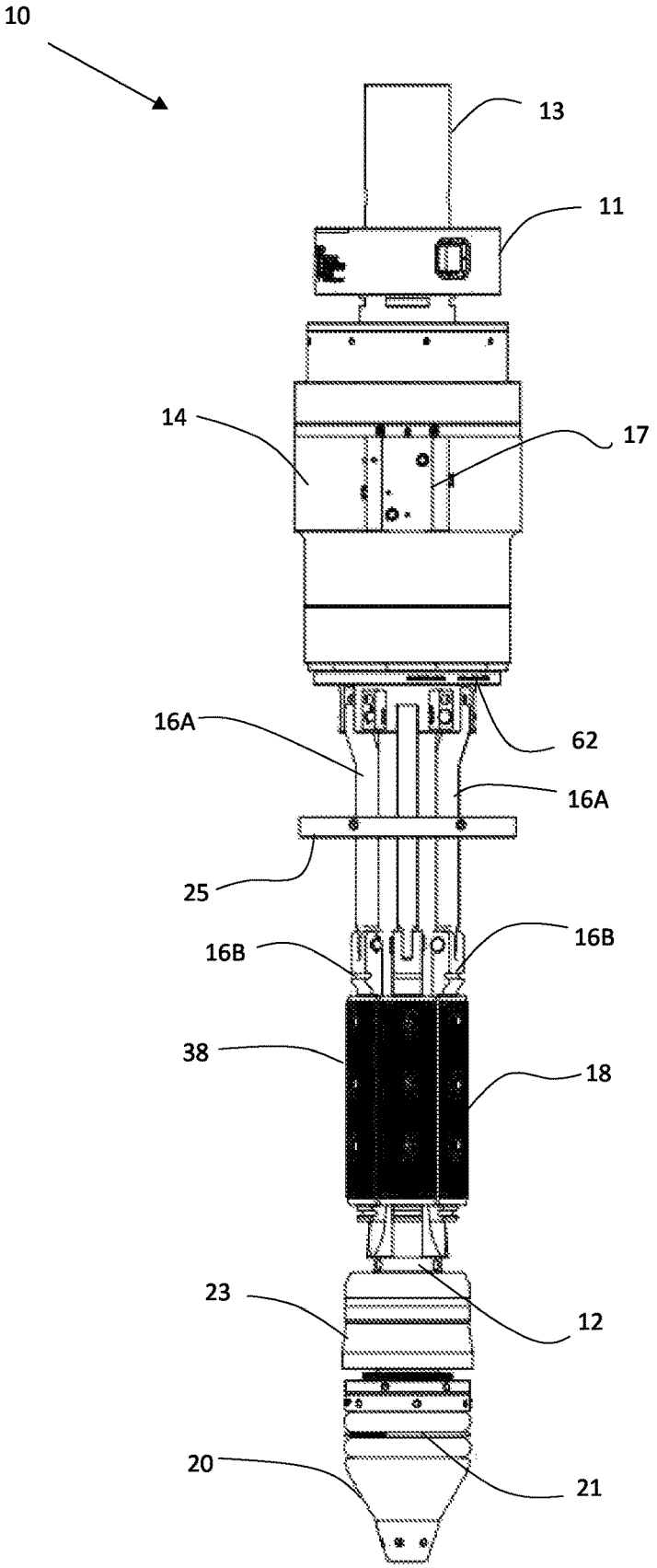
FIG. 8 shows a schematic of another tubular running tool according to an example of the present disclosure.

FIG. 8 shows another tubular running tool 10 embodiment of this disclosure. This tool 10 is similar to the embodiment of FIG. 1, including a mandrel 12, an actuator 14, a number of slips 16 disposed on the mandrel, and a spear head 20 disposed at the distal end of the mandrel. This embodiment is implemented with a number of multi-segment slips 16A, 16B. Each slip segment 16B is configured to hold a swappable insert 38 that provides a gripping portion 18. As used herein, the term "swappable" means readily and easily removeable and replaceable as a single part or component.

Figure 9:
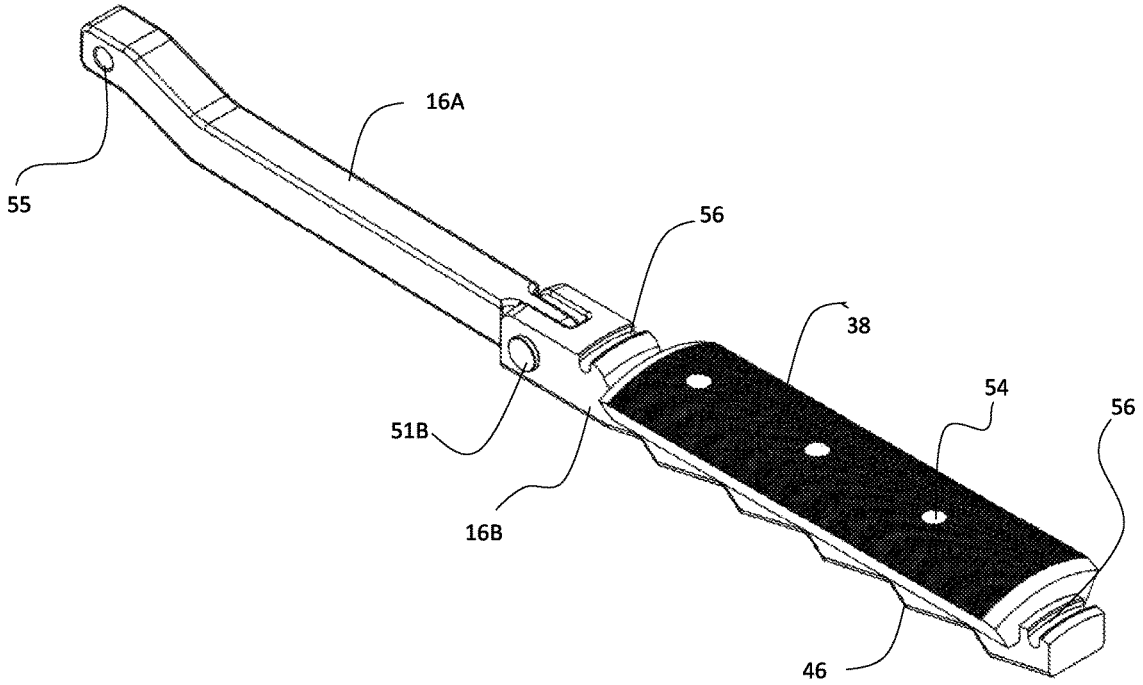
FIG. 9 shows a perspective view of a segmented tool slip with an insert according to an example of the present disclosure.

FIG. 9 shows a multi-segment slip embodiment, with an upper segment 16A coupled to a lower segment 16B via a pin 51B joint. The upper segment 16A includes a pin hole 55 formed at a far end of the segment to receive a pin 51B (see FIGS. 14A, 14B). The lower segment 16B has a swappable insert 38 mounted thereon. The inner side of the lower segment 16B is configured with stepped ramps 46. In some embodiments, the lower segment 16B may be configured with one or more grooves 56 formed near each end of the segment. The grooves 56 may be formed running horizontally from one side to the other along the surface of the segment 16B. Each groove 56 is configured to receive a flexible spring to provide a constricting force to keep the slips from extending outward until actuated as described herein.

Figure 10:
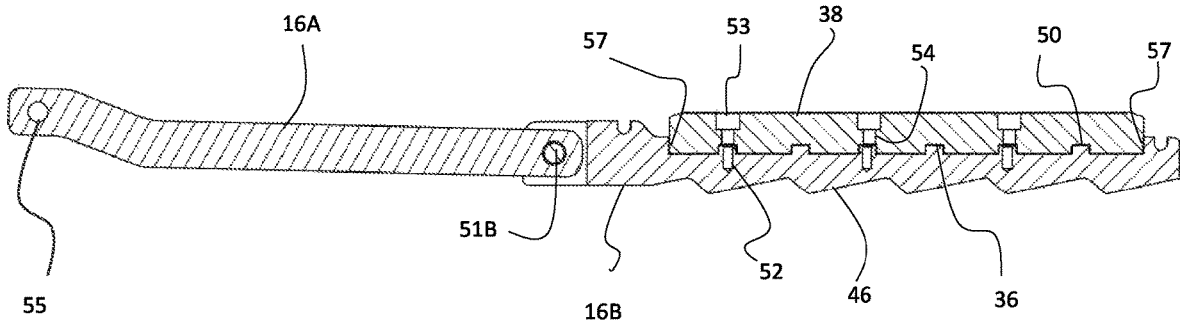
FIG. 10 shows a side view of the segmented tool slip of FIG. 9.

FIG. 10 shows a cross section of the multi-segment slip 16A, 16B of FIG. 9. A swappable insert 38 is mounted on slip such that the one or more raised alignment tabs 36 on the slip segment 16B are received by the respective one or more alignment tab receptacles 50 on the insert 38. Slip segment 16B is also configured with one or more threaded holes 52 to receive a fastening bolt 53 passed through a hole 54 formed on each insert 38. The inserts 38 can be swapped and interchanged on the slips 16 without having to remove the individual slips segments 16A, 16B from the mandrel 12. By swapping out the inserts 38 on the slip segments 16B using inserts of a selected height H (see FIG. 13), the overall diameter of the tool assembly can be set as desired so that the stem 24 portion of the mandrel 12 can be inserted into tubulars of various inside diameters. In this manner, tool 10 embodiments of this disclosure allow one to quickly and efficiently change the diameter of the tool mandrel 12 for use with tubulars of various IDs. For example, removal and replacement of the swappable inserts 38 can be easily and rapidly performed while the tool 10 remains suspended over a wellbore.

Figure 11A:
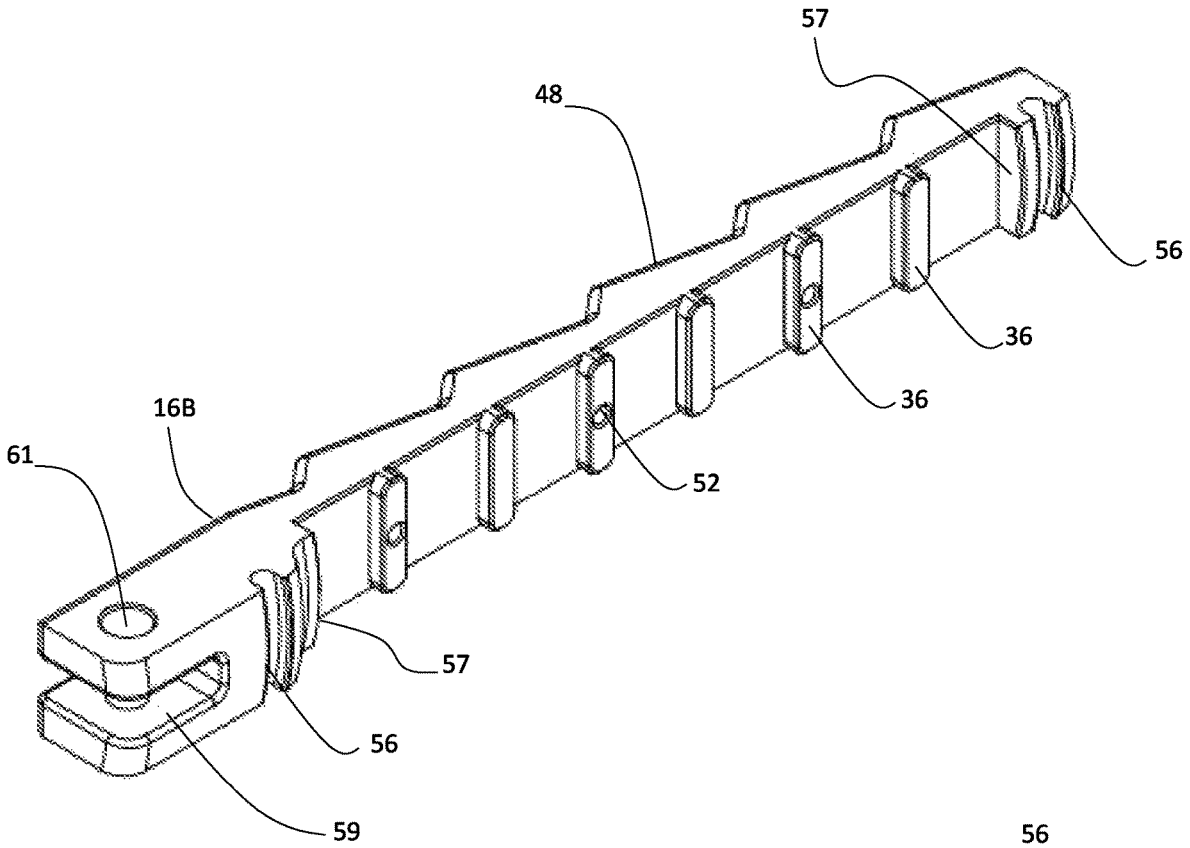
FIG. 11A shows a perspective view of a tool slip segment according to an example of the present disclosure.
Figure 11B:
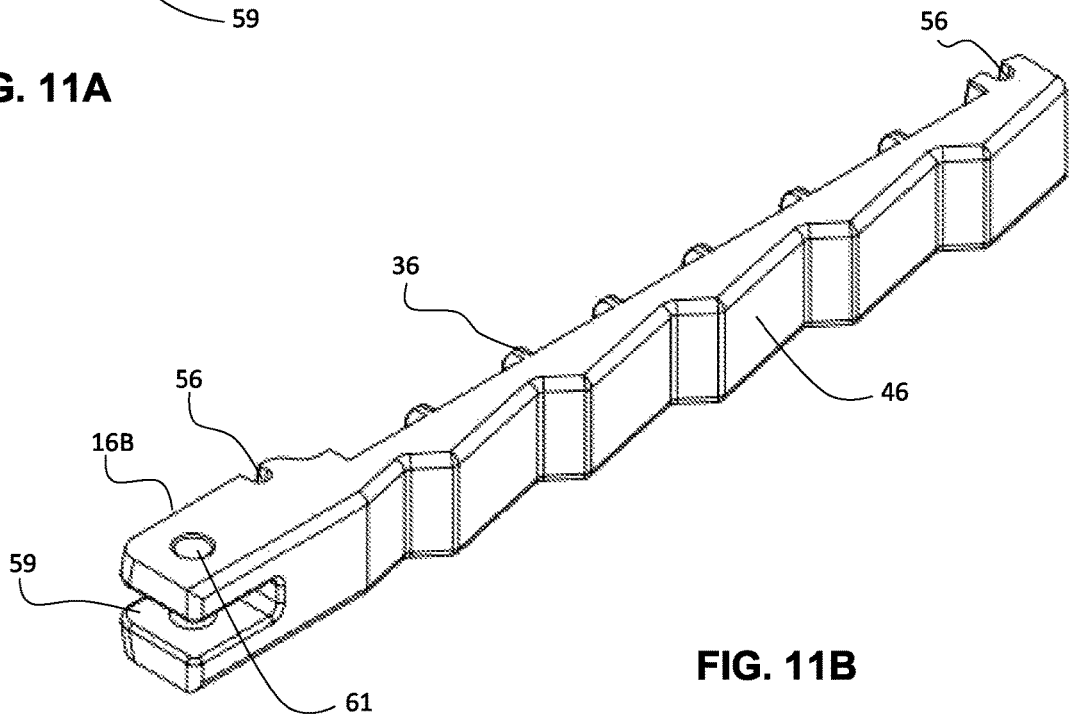
FIG. 11B shows a perspective view of the opposite side of the tool slip segment of FIG. 11A.

FIG. 11A shows an oblique view of a slip segment 16B embodiment. On the exterior side, the segment 16B is implemented with raised walls 57 that retain the swappable insert 38 from axial displacement when the insert in mounted onto the segment (see FIG. 10). A slot 59 is formed at the upper end of the lower segment 16B to receive the lower end of the upper segment 16A (see FIG. 9). A hole 61 is also formed at the upper end of the lower segment 16B to receive pin 51B (see FIG. 9). FIG. 11B shows the segment 16B of FIG. 11A from the opposite or inner side. The stepped ramps 46 are formed for complementary engagement with the offset stepped ramps 28 on the mandrel 12.

Figure 12A:
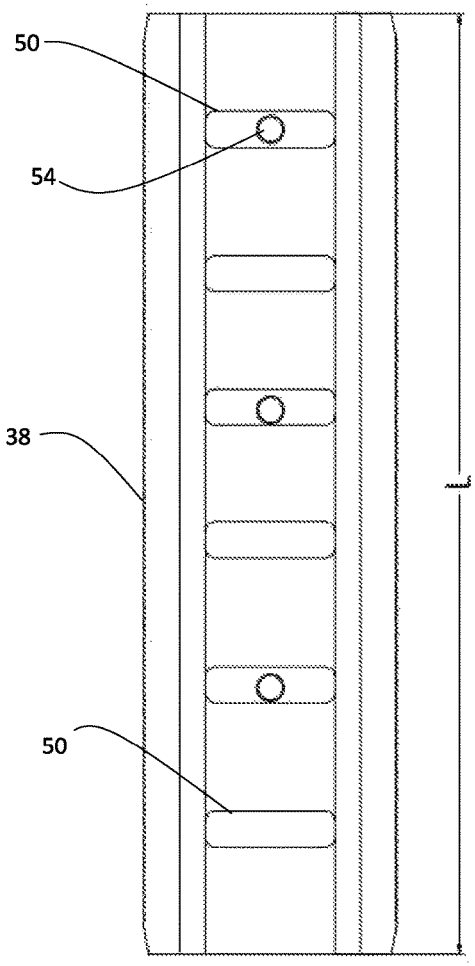
FIG. 12A shows a schematic of a swappable insert according to an example of the present disclosure.
Figure 12B:
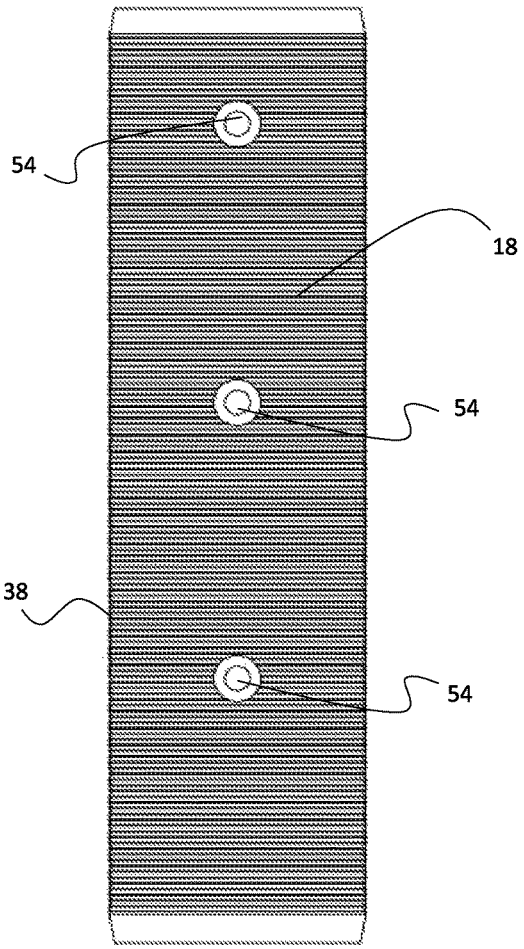
FIG. 12B shows a schematic of the opposite side of the swappable insert of FIG. 12A.

FIG. 12A shows the back or inner side of a swappable insert 38 configured for placement on a slip segment 16B as described herein (see FIG. 10). The insert 38 is formed as an elongated structure having a selected length L. FIG. 12B shows the opposite side of the insert 38 of FIG. 12A. This side forms the outer surface of the insert 38 and is configured with a gripping portion 18 to provide an abrasive or non-smooth surface. The gripping portion 18 may be formed via conventional techniques as known in the art (e.g., knurled surface, layer deposition, chemical treatment, shot peening, etc.).

Figure 13:
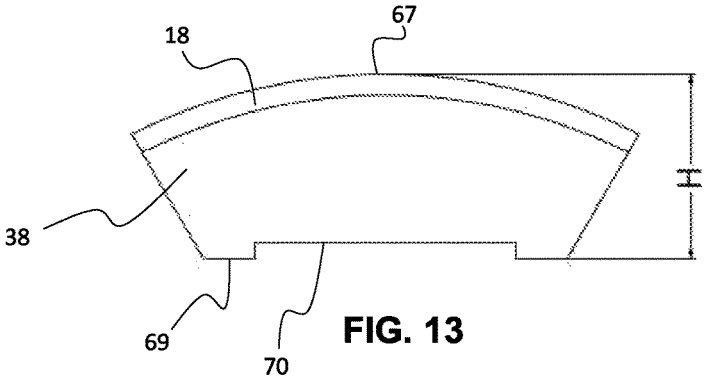
FIG. 13 shows an end view of an insert according to an example of the present disclosure.

FIG. 13 shows an end view of a swappable insert 38 embodiment. The insert 38 is formed with a circular sector profile 67 having a selected height H as measured from a generally planar base 69 to the gripping portion 18 forming the outer surface. Some embodiments may also be formed with an indented cradle section 70 providing side walls for more rigid mounting of the insert 38 onto the slip segment 16B. Conventional tubulars vary in internal diameter in relation to the weight of the tubular. Some operations require heavier weight pipe compared to other applications. The heavier the pipe, generally the thicker the wall of the pipe, and thus the variance in the ID of the different tubulars. It is also common to mix tubulars having different IDs in a single string during operations. The disclosed tools 10 allow one to quickly and easily swap inserts 38 in order to handle tubulars having different IDs without disruption to operations. By selecting a swappable insert 38 of a set height H, the overall mandrel 12 diameter can be easily altered and set as desired depending on the ID of the particular tubular to be run. The fastening bolts 53 (see FIG. 10) allow for convenient and rapid swapping of inserts 38 having different heights H to address the particular operation.

Figure 14A:
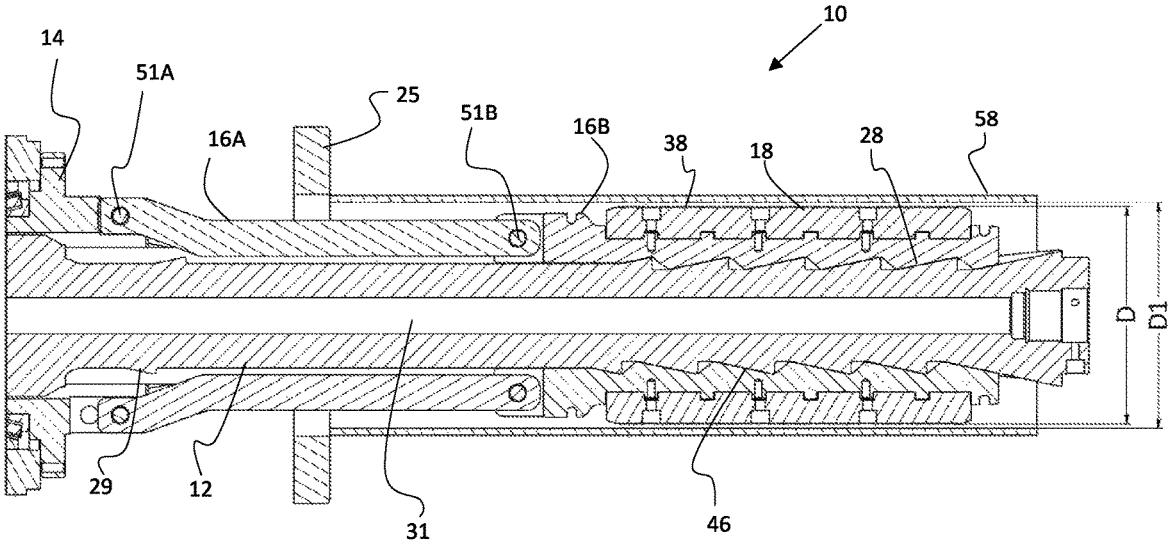
FIG. 14A shows a cross section of a mandrel in a neutral position within a tubular according to an example of the present disclosure.

FIG. 14A shows a cross section schematic of a tool 10 mandrel 12 embodiment of this disclosure configured with a pair of multi-segment slips 16A, 16B and inserts 38 disposed thereon. The end of the assembly is shown disposed in an open end of a tubular 58 having an inside diameter of D1. The assembly is inserted within the open end of the tubular 58 with the stepped ramps 46 of the slip segment 16B in complementary engagement with the offset stepped ramps 28 of the mandrel 12. In this mode, the tool 10 is in the neutral position. In the neutral position, the lands of the ramps 28 and 46 are mated in a low position such that the slip segments 16A, 16B lie close to the mandrel 12 body. In the neutral position, the overall tool assembly diameter is at a minimum D, which allows the tool to be disposed into the end of a tubular 58 of inner diameter D1 (where D1>D). As shown in FIG. 14A, with the segmented slips 16A, 16B the superior ramp 29 of the mandrel 12 is not engaged in any way in this configuration.

Figure 14B:
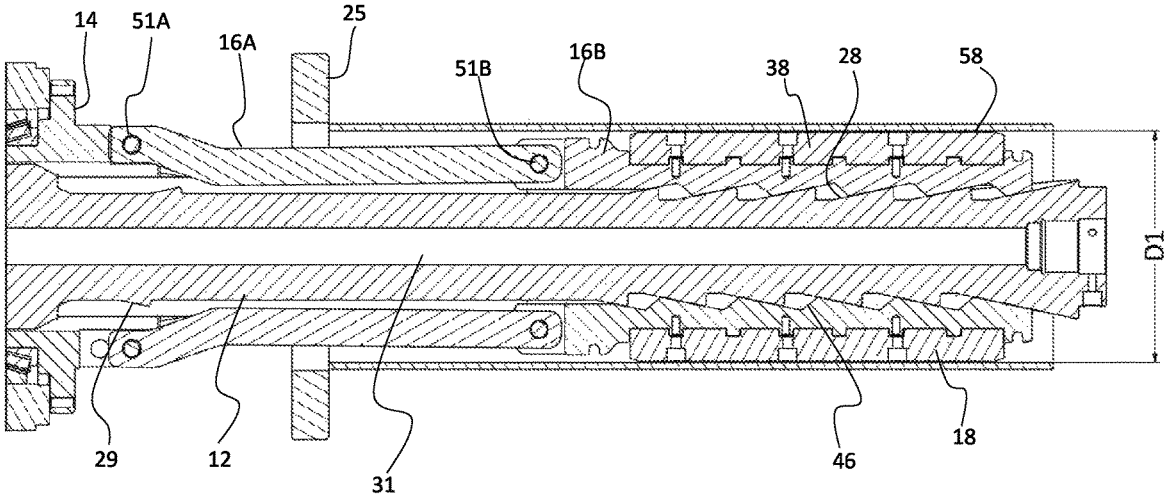
FIG. 14B shows a schematic of the mandrel of FIG. 14A in an extended position within the tubular according to an example of the present disclosure.

FIG. 14B shows the tool 10 of FIG. 14A with the mandrel 12 moved axially (to the left in FIG. 14B). As the mandrel 12 moves axially (e.g., up or towards the upper end of the tool 10), the offset stepped ramps 28 on the mandrel 12 respectively slide against the ramps 46 of the slip segments 16B. As depicted in FIG. 14B, as the peaks of the ramps 28 on the mandrel 12 slide axially against the ramps 46 on the slip segment 16B, the mandrel ramp peaks urge the slip segment 16B radially outwards. The pin 51A, 51B joints, respectively coupling the upper segment 16A to the actuator 14 and the upper segment 16A to the lower segment 16B, allow the segmented slips to pivot such that the lower segment 16B remains parallel to the longitudinal axis of the mandrel as the slips are actuated to expand radially outward, as depicted in FIG. 14B. As with the tool 10 embodiments of FIG. 1, these tool embodiments provide an advantage by reducing component fatigue. As the slip segments 16B are actuated to expand radially outward, the swappable insert 38 on each slip is correspondingly urged radially outward such that the gripping portion 18 on the outer surface of the insert remains parallel to the longitudinal axis of the mandrel as it makes contact with and secures against the inner diameter surface of the tubular 58. Once the tool 10 end is disposed in the open end of the tubular 58 and actuated to the extended position as described herein, the tubular is engaged and can be manipulated (e.g., raised, suspended, transported, lowered, rotated and/or torqued in connection with another tubular, etc.) by movement of the assembly as desired.

As disclosed herein, the mandrel 12 is moved axially on the tool 10 via the actuator 14 (see FIGS. 1, 8). In some embodiments, the actuator 14 comprises a hydraulic mechanism with an internal valve 17 that can be activated to move the mandrel 12 in one axial direction or the other via hydraulic fluid pressure as known in the art. For example, the actuator 14 may be implemented with a conventional hydraulic pilot valve 17 allowing flow direction to be switched to actuate movement of the mandrel 12 as desired. As depicted in FIG. 14B, an embodiment of the tool 10 is configured such that when the actuator 14 moves the mandrel 12 upward or toward the upper end of the tool (to the left in FIG. 14B), the slip segments 16B are urged radially outward into the extended position as described above, and when the mandrel moves downward or toward the lower end of the tool, the slips retract into the channels 26 on the mandrel and into the neutral position. In some embodiments, the actuator 14 may comprise an electromagnet configured with a conventional solenoid/spring mechanism coupled to the mandrel 12 to provide the axial motion. In other embodiments, the actuator 14 may comprise a conventional pneumatic piston-type mechanism coupled to the mandrel 12 to provide the axial motion.

It will be appreciated by those skilled in the art that embodiments of this disclosure may be implemented to suspend the tools 10 using conventional well site means (e.g., a conventional top drive on a drilling rig). Embodiments may also be implemented with the mandrel 12 having a standard box or pin type connection (13 in FIGS. 1, 8) at the upper end for coupling with a top drive, for example. It will also be appreciated that embodiments of the tool 10 may be used for land and offshore applications.

Once a tubular 58 is engaged by the tool 10, it can be suspended and moved to a desired location as described herein. For example, in a typical application the tool 10 will be used to engage a tubular 58 during the makeup of a tubular string at a well site. An advantage of the disclosed tools 10 is the ability to quickly and easily replace the slips 16, 16A, 16B, and/or swappable inserts 38 to run tubulars 58 (e.g., casing tubulars, drill collars, etc.) of different diameters without having to disassemble the mandrel 12 or disconnect the tool 10 from the rig. Another advantage provided by the disclosed tools 10 is the ability to make up the tubular 58 connections (e.g., pin-box type connections) and provide rotational torque to the determined torque specifications of the pipe manufacturer. In addition to providing rotational torque to the tubulars 58, the tool 10 embodiments also allow fluids, such as drilling mud, to be pumped into the tubulars 58 during make up of a string of drilling tubulars, for example. The fluids may be conveyed to the tool 10 via conduits linked to the tool as known in the art. In this manner, drilling mud pressure may be maintained within a string of drilling tubulars 58 as the tubular segments are manipulated by the tool 10.

In light of the principles and example embodiments described and depicted herein, it will be recognized that the example embodiments can be modified in arrangement and detail without departing from such principles. Also, the foregoing discussion has focused on particular embodiments, but other configurations are also contemplated. It will be appreciated by those skilled in the art that embodiments may be implemented using conventional software and computer systems programmed to perform the disclosed processes and operations. It will also be appreciated by those skilled in the art that embodiments may be implemented using conventional hardware and electrical/mechanical components to provide the linkages, couplings, connections, communications, hydraulic power units, etc., in accordance with the techniques disclosed herein. In view of the wide variety of useful permutations that may be readily derived from the example embodiments described herein, this detailed description is intended to be illustrative only, and should not be taken as limiting the scope of the invention.

What is claimed is:

1. A tubular running tool, comprising:

a mandrel having an elongated body with a longitudinal axis;

the mandrel having a plurality of stepped ramps on a surface thereof, wherein a plurality of the mandrel stepped ramps are offset from one another along the longitudinal axis of the mandrel;

a plurality of slips disposed on the mandrel;

each slip having a plurality of stepped ramps, wherein the stepped ramps of the slips are configured for complementary offset engagement along the mandrel longitudinal axis with the stepped ramps of the mandrel;

wherein the mandrel is configured with a first elongated channel to house one of the plurality of slips and a second elongated channel to house another one of the plurality of slips, with at least one cross-section along the mandrel longitudinal axis configured with the first channel formed shallower than the second channel;

each slip configured with a gripping portion on a surface thereof;

wherein the mandrel is configured for actuation to urge the slips radially outward to move the gripping portion on each slip outward for engagement with a tubular.

2. The tool of claim 1 wherein a first set of the plurality of the mandrel stepped ramps are offset from a second set of the plurality of the mandrel stepped ramps along the longitudinal axis, wherein the first set of stepped ramps is disposed 180 degrees from the second set of stepped ramps.

3. The tool of claim 1 wherein the slips each consist of multiple segments coupled together.

4. The tool of claim 1 further comprising a torque sensor disposed on the mandrel.

5. The tool of claim 1 wherein at least one slip is configured for disposal on the mandrel such that the gripping portion on the slip extends past the gripping portion on another slip disposed on the mandrel along the longitudinal axis.

6. The tool of claim 1 wherein the mandrel is configured for rotation about the longitudinal axis of the elongated body to provide a determined torque.

7. The tool of claim 1 further comprising a hydraulic actuator configured to actuate the mandrel to move the slips.

8. The tool of claim 1 wherein the mandrel is configured with a through bore to permit fluid flow therethrough.

9. The tool of claim 1 wherein the gripping portion on the slips consists of a gripping surface on an insert disposed on each slip.

10. A method for running a tubular, comprising:

suspending a mandrel above a wellbore, the mandrel having an elongated body with a longitudinal axis and a plurality of stepped ramps on a surface thereof, wherein a plurality of the mandrel stepped ramps are offset from one another along the longitudinal axis of the mandrel;

wherein a plurality of slips are disposed on the mandrel, each slip having a plurality of stepped ramps, wherein the stepped ramps of the slips are configured for complementary offset engagement along the mandrel longitudinal axis with the stepped ramps of the mandrel;

wherein the mandrel is configured with a first elongated channel to house one of the plurality of slips and a second elongated channel to house another one of the plurality of slips, with at least one cross-section along the mandrel longitudinal axis configured with the first channel formed shallower than the second channel;

wherein each slip is configured with a gripping portion on a surface thereof;

disposing a section of the mandrel into a tubular;

actuating the mandrel to urge the slips radially outward to move the gripping portion on each slip outward to engage the tubular.

11. The method of claim 10 wherein a first set of the plurality of the mandrel stepped ramps are offset from a second set of the plurality of the mandrel stepped ramps along the longitudinal axis, wherein the first set of stepped ramps is disposed 180 degrees from the second set of stepped ramps.

12. The method of claim 10 wherein the slips each consist of multiple segments coupled together.

13. The method of claim 10 wherein the mandrel comprises a torque sensor disposed thereon.

14. The method of claim 10 wherein at least one slip is configured for disposal on the mandrel such that the gripping portion on the slip extends past the gripping portion on another slip disposed on the mandrel along the longitudinal axis.

15. The method of claim 10 further comprising rotating the mandrel about the longitudinal axis of the elongated body to provide a determined torque.

16. The method of claim 10 further comprising actuating a hydraulic actuator on the mandrel to actuate the mandrel to move the slips.

17. The method of claim 10 further comprising flowing fluid through a through bore in the mandrel.

18. The method of claim 10 wherein the gripping portion on the slips consists of a gripping surface on an insert disposed on each slip.

* * * * *